US005461729A

United States Patent [19]

Brocks

[11] Patent Number: 5,461,729

[45] Date of Patent: Oct. 31, 1995

[54] MEN'S UNDERWEAR BRIEF

[76] Inventor: William Brocks, P.O. Box 509, Cross River, N.Y. 10518

[21] Appl. No.: 304,150

[22] Filed: Sep. 12, 1994

[51] Int. Cl.[6] ..... A41B 9/02

[52] U.S. Cl. ..... 2/403; 2/405; 2/401

[58] Field of Search ..... 2/400, 401, 402, 2/403, 404, 405, 406, 407, 408, 409

[56] References Cited

U.S. PATENT DOCUMENTS

| | | | |
|---|---|---|---|
| Re. 21,999 | 1/1942 | Kenibler | 2/403 |
| 2,664,889 | 1/1954 | Bailey | 2/403 |
| 2,695,610 | 11/1954 | McCabe | 2/403 |
| 3,283,545 | 11/1966 | Simon | 2/403 |
| 3,322,120 | 5/1967 | Wyss et al. | 2/401 |
| 3,499,442 | 3/1970 | Steinmetz | 2/403 |

*Primary Examiner*—C. D. Crowder
*Assistant Examiner*—Larry D. Worrell, Jr.
*Attorney, Agent, or Firm*—Martin J. Spellman, Jr.

[57] ABSTRACT

The invention relates to a male undergarment brief which through simple construction forms a defined genital pouch and a secured leg opening edge. The brief includes front and rear panels. The front panel comprises two knitted cotton panels having identical shapes which are obversely stitched together thereby forming overlapping fly openings. The two knitted panels provide for a pair of concave lower edges which make up a portion of the leg openings. The concave edges are provided with elastic strips which in their unstretched condition are approximately ⅔ the length of the concave edges. The elastic strips are each stretched to the length of the concave edges and then secured thereto. With the contraction of the elastic strips, a shirring takes place on the panels forming a genital pouch and secure leg openings.

1 Claim, 4 Drawing Sheets

MEN'S UNDERWEAR BRIEF

BACKGROUND OF THE INVENTION

1. Field of the Invention

This invention relates to men's knitted underwear briefs often referred to a "Jockey shorts". The design of this type of men's brief of similar construction widely sold under many brand names often causes an annoying discomfort, discomfiture, and embarrassment by allowing the scrotal sack or any part thereof to slip through the band encircling the legs. Also there is no particular pouch defined by the construction to accommodate the male genital organs. The structure of the briefs according to the invention, in particular the construction of the front panel of the briefs joining the panel plys forms a soft pouch or cage enveloping the male privates and genital area, thereby providing greater comfort and security, and eliminating the foregoing problems. This is achieved by the inclusion of elastic sections added to each hem along the curved edge of the leg opening portion of the inserted front panel plys.

2. Prior Art

Men's briefs are pretty much a standard commodity on the market being sold by many companies. All generally employ the same standard construction having overlapping cotton double panels in the front to define the fly opening; the front panel being joined to the rear panels and then a unifying waistband stitched to the joined panel units. The usual material employed is a cotton knitted material having stretch along the lateral axis and having very little stretch along the longitudinal or the vertical axis.

Of background interest, a variation in this structure in an undergarment which attempts to provide abdominal support shown in U.S. Pat. No. 3,038,471, Van Horne disclosing a brief having some of the characteristics of a girdle including elastic strips crisscrossing in the overlapped panels at the front of the device. The purpose therein is to provide abdominal support and it thus functions actually as the antithesis of the present invention. It is binding across the male genital areas as opposed to the present structure.

U.S. Pat. No. 2,854,669, Cohen discloses elastic leg openings but they do not define a pouch or a cage as provided according to the present invention.

Other references developed during the course of prior investigation by applicant of general background interest only and are: U.S. Pat. No. 2,114,634, Jean, U.S. Pat. No. 2,641,257 Rutledge and U.S. Pat. No. 2,652,053, Dann.

SUMMARY OF THE INVENTION

In accordance with the present invention, a new male undergarment brief provides a great improvement over existing briefs through a simple construction means that forms a defined genital pouch and a secured leg opening edge to assure that male genitals do not partially escape as is often the case with the standard briefs presently available on the market. The briefs of the present invention include the usual rear panel joined to the front insert panel which is cut to match. The rear and front panels are joined at the top edges to the waistband and joined at the lower end by a common seam, the arches and front diagonal seams, together defining the leg openings.

According to the present invention, the front panel is comprised of two knitted cotton pieces having the same shape. The pieces which are obversely stitched together thereby forming or defining the usual overlapping fly openings. The front panel edges are later joined with the rear panel and the lower edge joined with the lower edge of the rear panel and together concave lower side edges to define the leg openings, overlapping fly openings.

In accordance with the present invention, the concave leg opening arches of the assembled front panel are provided with elastic strips which in their unstretched condition are approximately two-thirds the length of each leg opening arch of the front panel. In assembling, the elastic strips are each stretched to the length of each of the concave leg opening arches of the front panel, causing the stitched material to be gathered together and thereby define a genital pouch in the form of shirring when the stretching force is released. The arches are then stretched to their usual size and stitched together with the back panel in the standard manner, defining the genital pouch.

The present structure provides security for the male genital parts to prevent them from slipping under the edge of either leg opening and provide a comfortable pouch for the genitals.

BRIEF DESCRIPTION OF THE DRAWING

In the accompanying drawing which forms a part of the specification.

ILLUSTRATIVE SPECIFIC EMBODIMENT

Figure 1:
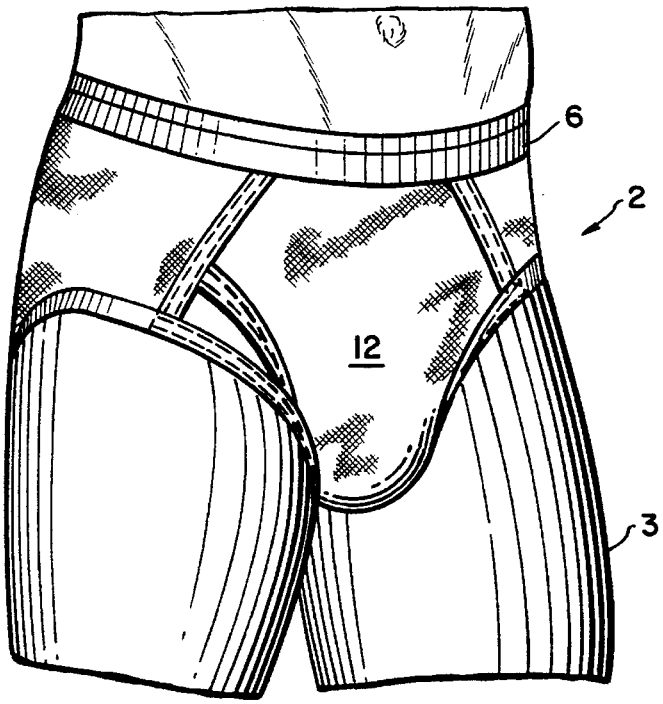
FIG. 1 is a perspective view of the undergarment briefs of the present invention worn by a user.
Figure 2:
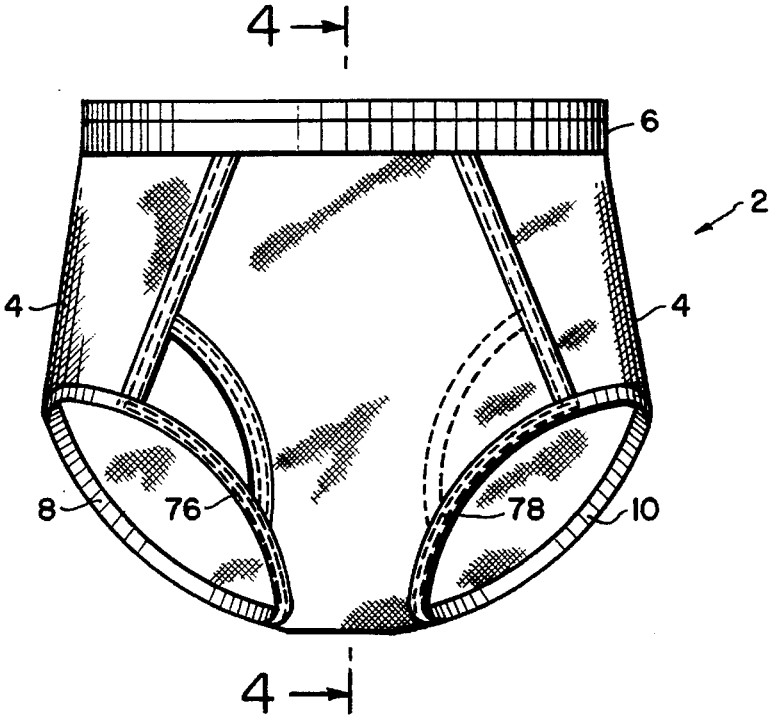
FIG. 2 is a front view of the garment.

The brief 2 of the present invention is shown on a wearer 3 in FIG. 1. A general plan view of the front thereof is shown in FIG. 2.

The brief includes a trunk or rear portion 4 and waist band 6 and leg bands 7 and 11. The trunk section 4 is cut with leg openings 8 and 10 and a bottom seam section 9. The front panel insert 12 is joined along seams with the trunk portion 4 and together with the trunk portion 4 is stitched at the upper edge to the waistband 6. The structure of the insert 12 is shown in detail in FIGS. 6–9.

As in the case of the brief's presently in common use, the front insert 12 is comprised of similar overlapping knitted cotton panels 14 and 16 having the same shape, which are obversely stitched together, the outer panel 14 over the inner panel 16.

Figure 6:
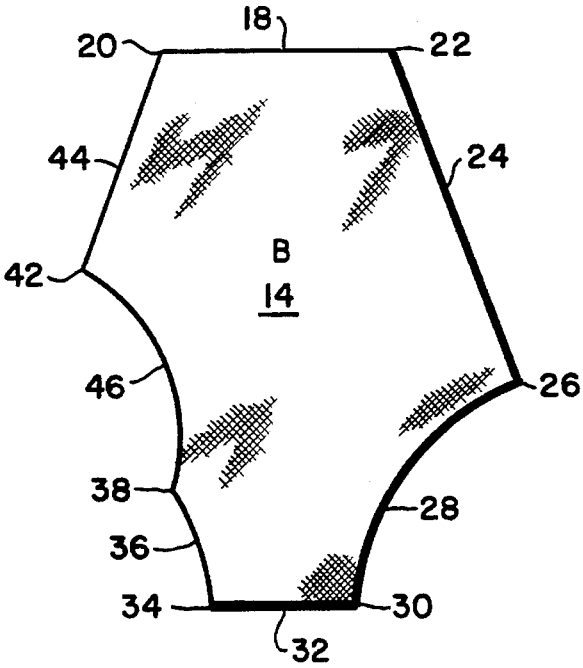
FIG. 6 is a plan view of the top layer of the front panel.

Referring to FIG. 6, the outer panel 14 has a top edge 18 with corners 20 and 22. The side edge 24 runs between the corners 22 and 26. A concave arch 28 defining portions of the leg opening runs between corner 26 and cover 30. The bottom edge 32 of panel 14 which is joined by stitching with the matching edge 9 of the lower portion of the rear section 4. This edge 32 runs between corners 30 and 34. An upperwardly extending concave section 36 forming a portion of the leg opening of front panel 12 runs between points 34 and 38 with a inwardly cut concave section 40 running between points 38 and 42 defining the outer flap of the fly opening. The side edge seam 44 rises upwardly and diagonally inward between point 42 and point 20 at the top edge 18.

Figure 7:
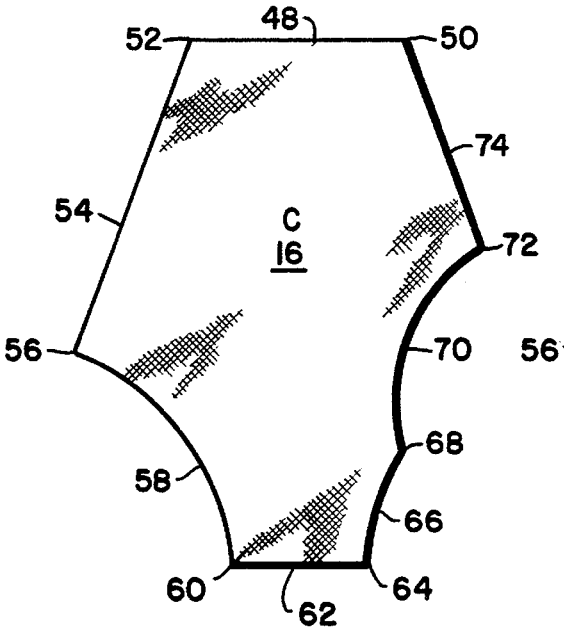
FIG. 7 is a plan view of the inner layer of the insert panel shown in FIG. 3.

A similarly shaped but reversely oriented inner panel section 16 is shown in FIG. 7 with a top edge 48 having corners 50 and 52 diagonally descending along edge 54 running to point 56, concave leg opening section 58 terminating at corner 60, bottom edge 62 running to the corner 64. A portion of the leg opening is defined by the concave section 66 running between points 64 and 68, and an inwardly extending concave section 70 between points 68 and 72 defines a portion of the fly opening. The upwardly and diagonally extending edge 74 runs between points 72 and 50.

Figure 8:
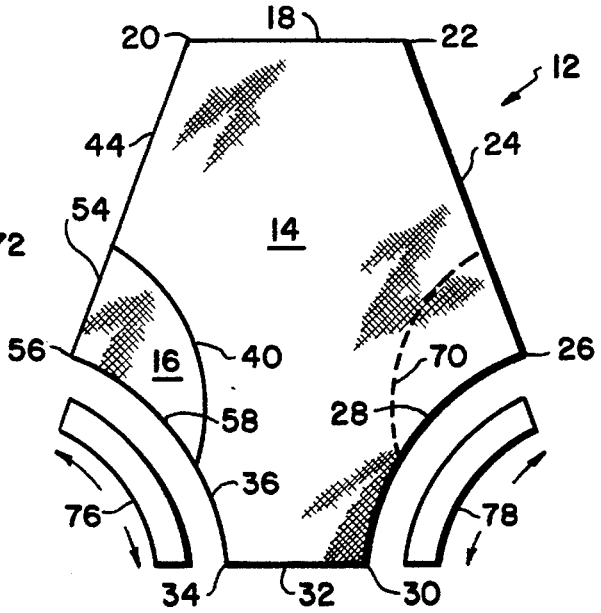
FIG. 8 is a plan view of the outer layer of the insert together with the elastic strips that are added along the leg portion arches indicating the stretch.

FIG. 8 shows the panel 12 formed when the section 14 is superimposed over 16 and the sections 14 and 16 stitched along their overlapping common edges. The nonoverlapping edges forming the fly openings are hemmed appropriately.

In FIG. 8 elastic strips 76 and 78 are indicated with the arrows showing the direction of their stretch. The elastic 78 in its non-stretched condition is approximately two thirds of the length of the leg opening arches running between point 56 of the underlying panel 16 and point 34 of the overlying panel 14, along the right leg opening, and similarly, the elastic 78 is stitched in its stretched condition along the arch 28 running between point 26 of under panel 16 and point 30 of the overlying panel 14.

Figure 3:
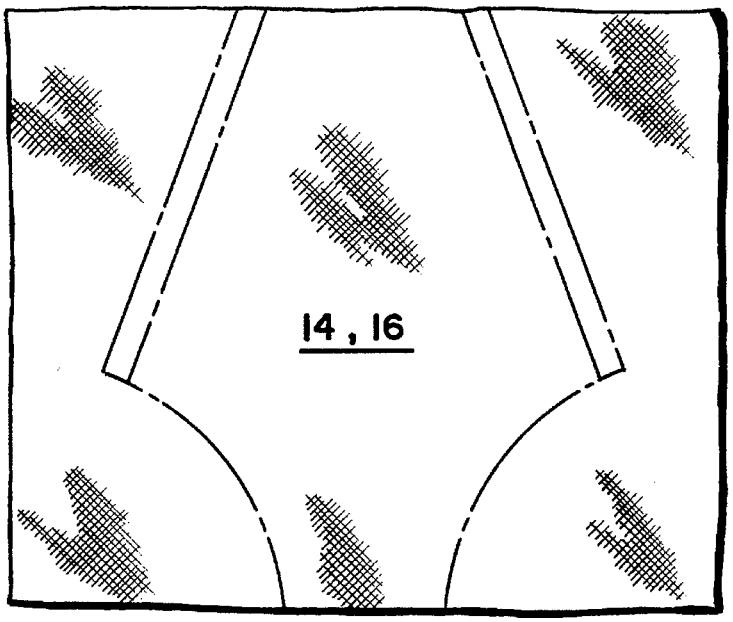
FIG. 3 is a front plan view of the cloth from which the front pieces front insert pieces for the garment are cut.
Figure 4:
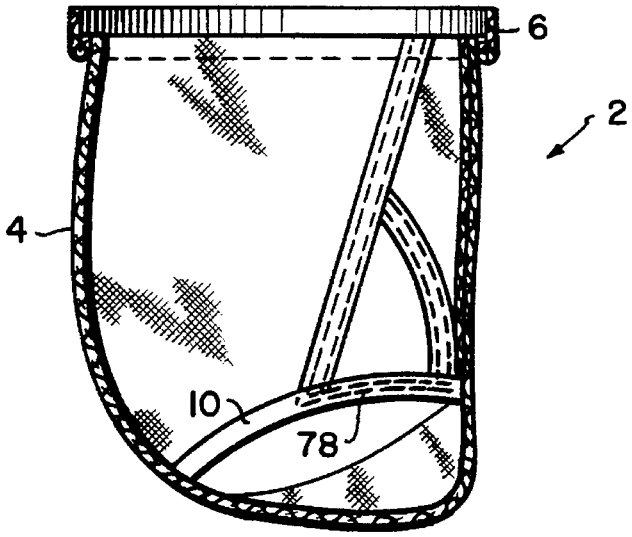
FIG. 4 is a sectional view taken along lines 4—4 of FIG. 2.
Figure 5:
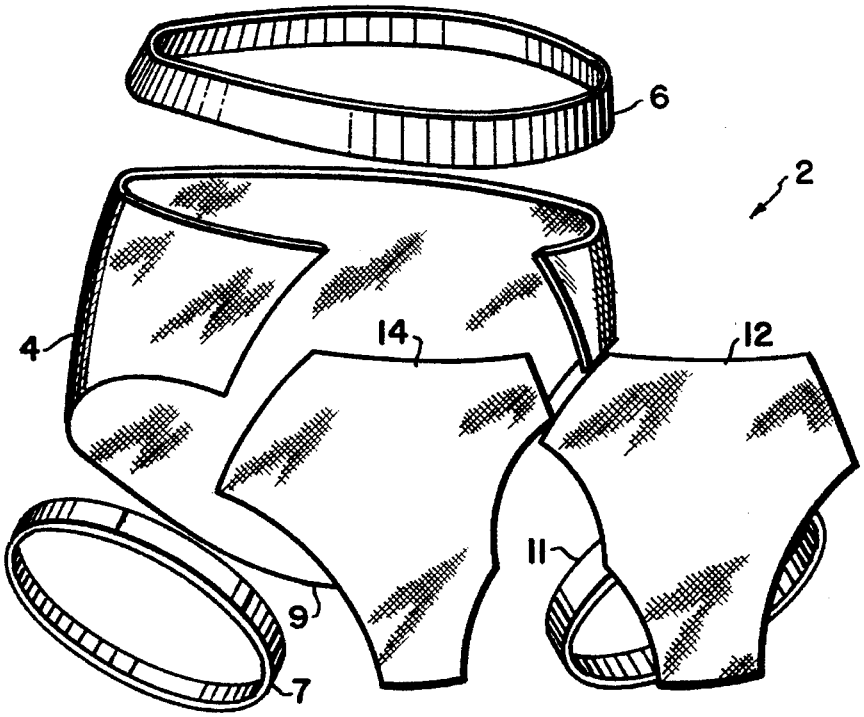
FIG. 5 is a perspective exploded view of the various components of the brief of the invention.
Figure 9:
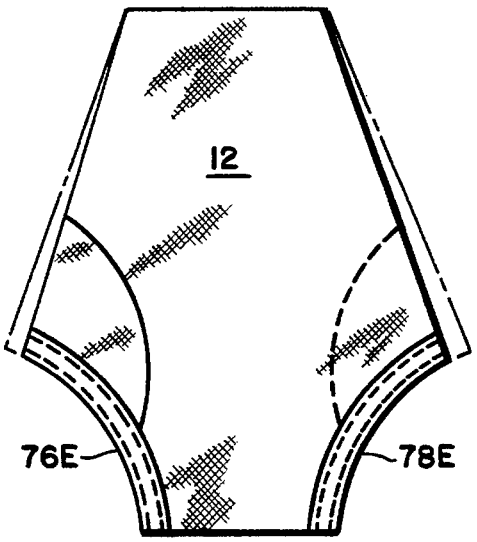
FIG. 9 is a view of the insert showing the gathering of the elastic along the leg opening forming shirring and of the defined pouch or cage and indicating in dashed lines the stretching.

In FIG. 9, the panel 12 is shown with the elastic gathered into shirring form as indicated at 76E and 78E. The dashed lines indicate the stretched condition. Once the finished panel 12 is thus assembled the elastic is restretched and the panel 12 stitched together with the rear section 4. The cotton material used is generally stretchable along only the lateral axis and not the longitudinal axis. After the sections 4 and 12 are stitched together, waistband 6 is stitched over the assembled section as shown in FIG. 2. The elastic strips create a gathering and shirring forming a secure enclosure pouch for the male genitals as generally indicated in FIGS. 1 and 3.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A man's underwear brief comprising a back panel, a front panel including an outer and inner panels having identical shapes and obversely stitched together, a waistband secured to upper edges of said inner and outer panels, a pair of concave lower edges of said inner and outer panels together forming a portion of leg openings, concave lower edges of said front panel having stitched thereto elastic strips in their stretched state which in their unstretched state are approximately ⅔ the length of said concave edges of said front panel, said strips contracting in the unstretched state to form a shirring effect on said concave panels thereby forming a genital pouch and secure leg enclosures.

* * * * *